US008759267B2

(12) United States Patent
Tellier et al.

(10) Patent No.: US 8,759,267 B2
(45) **Date of Patent: *Jun. 24, 2014**

(54) METHOD FOR IMPROVING THE FUEL EFFICIENCY OF ENGINE OIL COMPOSITIONS FOR LARGE LOW AND MEDIUM SPEED ENGINES BY REDUCING THE TRACTION COEFFICIENT

(75) Inventors: Kathleen H. Tellier, Cherry Hill, NJ (US); Vincent M. Carey, Sewell, NJ (US); Kevin L. Crouthamel, Richboro, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 237 days.

This patent is subject to a terminal disclaimer.

(21) Appl. No.: 13/016,474

(22) Filed: Jan. 28, 2011

(65) Prior Publication Data

US 2011/0195878 A1 Aug. 11, 2011

Related U.S. Application Data

(60) Provisional application No. 61/337,182, filed on Feb. 1, 2010.

(51) Int. Cl.
*C10M 107/02* (2006.01)

(52) U.S. Cl.
USPC ..... 508/591; 208/19; 508/110

(58) Field of Classification Search
USPC ..... 508/591
See application file for complete search history.

(56) References Cited

U.S. PATENT DOCUMENTS

| | | | |
|---|---|---|---|
| 2,978,442 | A | 4/1961 | Brightbill et al. |
| 3,149,178 | A | 9/1964 | Hamilton et al. |
| 3,164,578 | A | 1/1965 | Baker et al. |
| 3,382,291 | A | 5/1968 | Brennan |
| 3,576,923 | A | 4/1971 | Randell et al. |
| 3,742,082 | A | 6/1973 | Brennan |
| 3,769,363 | A | 10/1973 | Brennan |
| 3,780,128 | A | 12/1973 | Shubkin |
| 3,876,720 | A | 4/1975 | Heilman et al. |
| 3,883,417 | A | 5/1975 | Woo et al. |
| 4,016,349 | A | 4/1977 | McKenna |

(Continued)

FOREIGN PATENT DOCUMENTS

| | | |
|---|---|---|
| EP | 0119069 A2 | 9/1984 |
| EP | 0119792 A1 | 9/1984 |

(Continued)

OTHER PUBLICATIONS

Ferdinand Rodrigues, "The Molecular Weight of Polymers in Principles of Polymer Systems", Chapter 6, McGraw-Hill, 1970, pp. 115-144.

(Continued)

*Primary Examiner* — Ellen McAvoy
(74) *Attorney, Agent, or Firm* — Robert A. Migliorini

(57) ABSTRACT

The present invention is directed to a method for improving the fuel efficiency of low and medium speed engine oil compositions by reducing the traction coefficient of the oil by formulating the oil using at least two base stocks of different kinematic viscosity wherein the differences in kinematic viscosity between the base stocks is at least 30 $mm^2/s$.

4 Claims, 4 Drawing Sheets

(56) References Cited

U.S. PATENT DOCUMENTS 4,132,663 A 1/1979 Heilman et al.
4,149,178 A 4/1979 Estes
4,172,855 A 10/1979 Shubkin et al.
4,218,330 A 8/1980 Shubkin
4,234,435 A 11/1980 Meinhardt et al.
4,239,930 A 12/1980 Allphin et al.
4,263,150 A 4/1981 Clason et al.
4,263,465 A 4/1981 Sheng et al.
4,289,635 A 9/1981 Schroeck
4,308,154 A 12/1981 Clason et al.
4,367,352 A 1/1983 Watts, Jr. et al.
4,413,156 A 11/1983 Watts, Jr. et al.
4,417,990 A 11/1983 Clason et al.
4,434,408 A 2/1984 Baba et al.
4,451,684 A 5/1984 Pasky
4,469,912 A 9/1984 Blewett et al.
4,587,368 A 5/1986 Pratt
4,652,416 A 3/1987 Millot
4,701,489 A 10/1987 Hughes et al.
4,704,491 A 11/1987 Tsutsui et al.
4,776,967 A 10/1988 Ichihashi et al.
4,827,064 A 5/1989 Wu
4,827,073 A 5/1989 Wu
4,892,851 A 1/1990 Ewen et al.
4,906,350 A 3/1990 Lucien et al.
4,906,799 A 3/1990 Forbus, Jr. et al.
4,910,355 A 3/1990 Shubkin et al.
4,912,272 A * 3/1990 Wu ..... 585/10
4,914,254 A 4/1990 Pelrine
4,922,046 A 5/1990 Kinoshita et al.
4,926,004 A 5/1990 Pelrine et al.
4,943,383 A 7/1990 Avery et al.
4,950,822 A 8/1990 Dileo et al.
4,956,122 A 9/1990 Watts et al.
4,962,249 A 10/1990 Chen et al.
4,962,262 A 10/1990 Winter et al.
4,967,032 A 10/1990 Ho et al.
4,990,709 A 2/1991 Wu
4,990,711 A 2/1991 Chen et al.
5,012,020 A 4/1991 Jackson et al.
5,017,299 A 5/1991 Gutierrez et al.
5,017,714 A 5/1991 Welborn, Jr.
5,057,235 A 10/1991 Farng et al.
5,068,487 A 11/1991 Theriot
5,075,269 A 12/1991 Degnan et al.
5,087,788 A 2/1992 Wu
5,104,579 A 4/1992 Benjamin et al.
5,105,038 A 4/1992 Chen et al.
5,113,030 A 5/1992 Chen et al.
5,132,478 A 7/1992 Ho et al.
5,146,021 A 9/1992 Jackson et al.
5,157,177 A 10/1992 Pelrine et al.
5,177,276 A 1/1993 Beach et al.
5,180,865 A 1/1993 Heilman et al.
5,186,851 A 2/1993 Gutierrez et al.
5,187,250 A 2/1993 Asanuma et al.
5,188,724 A 2/1993 Heilman et al.
5,188,746 A 2/1993 Davis
5,190,682 A 3/1993 Harris
5,208,403 A 5/1993 Buchanan et al.
5,220,100 A 6/1993 Massie et al.
5,243,114 A 9/1993 Johnson et al.
5,254,274 A 10/1993 Ho et al.
5,264,642 A 11/1993 Wu
5,275,749 A 1/1994 Kugel et al.
5,276,227 A 1/1994 Wu et al.
5,276,277 A 1/1994 Hightower et al.
5,315,053 A 5/1994 Beach et al.
5,369,196 A 11/1994 Matsumoto et al.
5,382,739 A 1/1995 Atkins et al.
5,436,379 A 7/1995 Heilman et al.
5,462,995 A 10/1995 Hosaka et al.
5,498,815 A 3/1996 Schaerfl, Jr. et al.
5,602,086 A 2/1997 Le et al.
5,679,812 A 10/1997 Winter et al.
5,688,887 A 11/1997 Bagheri et al.
5,705,577 A 1/1998 Rossi et al.
5,726,133 A 3/1998 Blahey et al.
5,731,254 A 3/1998 Winter et al.
5,807,949 A 9/1998 Rossi et al.
5,811,379 A 9/1998 Rossi et al.
5,817,605 A 10/1998 Papay
5,846,896 A 12/1998 Ewen
5,852,143 A 12/1998 Sishta et al.
5,858,935 A 1/1999 Watts et al.
5,859,159 A 1/1999 Rossi et al.
6,043,401 A 3/2000 Bagheri et al.
6,080,301 A 6/2000 Berlowitz et al.
6,087,307 A 7/2000 Kaminski et al.
6,090,989 A 7/2000 Trewella et al.
6,133,209 A 10/2000 Rath et al.
6,140,281 A 10/2000 Blahey et al.
6,143,701 A * 11/2000 Boffa ..... 508/363
6,147,271 A 11/2000 Strebel et al.
6,165,949 A 12/2000 Berlowitz et al.
6,180,575 B1 1/2001 Nipe
6,184,186 B1 2/2001 Ryan et al.
6,191,081 B1 2/2001 Cartwright et al.
6,339,051 B1 1/2002 Carey et al.
6,388,032 B1 5/2002 Yamaura et al.
6,395,948 B1 5/2002 Hope et al.
6,414,090 B2 7/2002 Minami et al.
6,429,178 B1 8/2002 Skinner et al.
6,479,722 B1 11/2002 De Wet et al.
6,548,723 B2 4/2003 Bagheri et al.
6,548,724 B2 4/2003 Bagheri et al.
6,589,920 B2 7/2003 Okada et al.
6,613,724 B2 9/2003 Strickland et al.
6,642,169 B2 11/2003 Weatherhead
6,645,922 B2 11/2003 Dunn et al.
6,646,174 B2 11/2003 Clarembeau
6,706,828 B2 3/2004 DiMaio
6,713,438 B1 3/2004 Baillargeon et al.
6,790,813 B2 * 9/2004 Boffa ..... 508/198
6,824,671 B2 11/2004 Goze et al.
6,858,767 B1 2/2005 DiMaio et al.
6,869,917 B2 3/2005 Deckman et al.
7,022,784 B2 4/2006 Wu et al.
7,045,055 B2 5/2006 Ziemer et al.
7,060,768 B2 6/2006 Brookhart et al.
7,101,830 B2 9/2006 Owen et al.
7,129,197 B2 10/2006 Song et al.
7,312,185 B2 12/2007 Willey et al.
7,407,919 B2 * 8/2008 Wilk et al. ..... 508/399
7,476,645 B2 * 1/2009 Rosenbaum et al. ..... 508/110
7,544,850 B2 6/2009 Goze et al.
7,547,811 B2 6/2009 Kramer et al.
7,585,820 B2 * 9/2009 Kleijwegt ..... 508/192
7,585,823 B2 9/2009 Sullivan et al.
7,592,411 B2 9/2009 Wu et al.
7,592,497 B2 9/2009 Yang et al.
7,683,013 B2 * 3/2010 Carey et al. ..... 508/110
7,704,930 B2 * 4/2010 Deckman et al. ..... 508/460
7,795,194 B2 9/2010 Iimura et al.
7,989,408 B2 * 8/2011 Poirier et al. ..... 508/486
8,105,991 B2 * 1/2012 Dowding et al. ..... 508/391
8,143,200 B2 * 3/2012 Vaughn et al. ..... 508/110
8,247,358 B2 * 8/2012 Lee et al. ..... 508/499
8,299,007 B2 * 10/2012 Carey et al. ..... 508/591
8,318,993 B2 * 11/2012 Wu et al. ..... 585/12
8,399,390 B2 * 3/2013 Wu et al. ..... 508/591
8,476,205 B2 * 7/2013 Lee et al. ..... 508/465
2001/0041817 A1 11/2001 Bagheri et al.
2001/0041818 A1 11/2001 Bagheri et al.
2002/0144853 A1 10/2002 Martin
2003/0013623 A1 1/2003 Tse et al.
2003/0055184 A1 3/2003 Song et al.
2003/0092585 A1 5/2003 O'Connor et al.
2003/0158055 A1 8/2003 Deckman et al.
2003/0191032 A1 10/2003 Deckman et al.
2003/0207775 A1 11/2003 Sullivan et al.
2003/0236177 A1 12/2003 Wu et al.
2004/0002429 A1 1/2004 Forbus, Jr.
2004/0029747 A1 2/2004 Emert et al.

(56) References Cited

U.S. PATENT DOCUMENTS

| | | | | |
|---|---|---|---|---|
| 2004/0033908 | A1 | 2/2004 | Deckman et al. | |
| 2004/0087746 | A1 | 5/2004 | Razavi | |
| 2004/0092408 | A1 | 5/2004 | Willey et al. | |
| 2004/0097772 | A1 | 5/2004 | Deckers et al. | |
| 2004/0147693 | A1 | 7/2004 | DiMaio | |
| 2004/0214733 | A1 | 10/2004 | Baba | |
| 2004/0220359 | A1 | 11/2004 | Abhari et al. | |
| 2004/0225088 | A1 | 11/2004 | Vaughan et al. | |
| 2004/0230016 | A1 | 11/2004 | Blackborow et al. | |
| 2005/0059563 | A1 | 3/2005 | Sullivan et al. | |
| 2005/0101761 | A1 | 5/2005 | Lambert et al. | |
| 2005/0113621 | A1 | 5/2005 | Hope et al. | |
| 2005/0124509 | A1 | 6/2005 | Gutierrez et al. | |
| 2005/0148478 | A1 | 7/2005 | Ozbalik et al. | |
| 2005/0183988 | A1 | 8/2005 | Freerks et al. | |
| 2005/0250657 | A1 | 11/2005 | Wu et al. | |
| 2006/0116300 | A1 | 6/2006 | Arrowsmith et al. | |
| 2006/0116303 | A1 | 6/2006 | Iimura et al. | |
| 2006/0122073 | A1 | 6/2006 | Hewette | |
| 2006/0131210 | A1 | 6/2006 | Rosenbaum et al. | |
| 2006/0157383 | A1 | 7/2006 | Wu et al. | |
| 2006/0178279 | A1 | 8/2006 | Sullivan et al. | |
| 2006/0199743 | A1 | 9/2006 | Rosenbaum et al. | |
| 2006/0270568 | A1 | 11/2006 | Kawata | |
| 2006/0276355 | A1 | 12/2006 | Carey et al. | |
| 2006/0281643 | A1 | 12/2006 | Habeeb et al. | |
| 2007/0000807 | A1 | 1/2007 | Wu et al. | |
| 2007/0043248 | A1 | 2/2007 | Wu et al. | |
| 2007/0208151 | A1 | 9/2007 | Okada et al. | |
| 2007/0289897 | A1 | 12/2007 | Carey et al. | |
| 2007/0298990 | A1 | 12/2007 | Carey et al. | |
| 2008/0020954 | A1 | 1/2008 | Haigh et al. | |
| 2008/0177121 | A1 | 7/2008 | Wu et al. | |
| 2008/0207475 | A1 | 8/2008 | Haigh et al. | |
| 2009/0005279 | A1 | 1/2009 | Wu et al. | |
| 2009/0011963 | A1* | 1/2009 | Anderson et al. | 508/192 |
| 2009/0036725 | A1 | 2/2009 | Wu et al. | |
| 2009/0042753 | A1 | 2/2009 | Poirier et al. | |
| 2009/0088356 | A1 | 4/2009 | Hee et al. | |
| 2009/0093657 | A1 | 4/2009 | Buchanan et al. | |
| 2009/0156874 | A1 | 6/2009 | Patil et al. | |
| 2009/0186784 | A1 | 7/2009 | Diggs et al. | |
| 2009/0240012 | A1 | 9/2009 | Patil et al. | |
| 2010/0006259 | A1 | 1/2010 | Mori et al. | |
| 2010/0048438 | A1 | 2/2010 | Carey et al. | |
| 2010/0062959 | A1* | 3/2010 | Vaughn et al. | 508/591 |
| 2010/0087349 | A1 | 4/2010 | Lee et al. | |
| 2010/0105585 | A1 | 4/2010 | Carey et al. | |
| 2010/0256026 | A1 | 10/2010 | Wu et al. | |
| 2010/0292424 | A1 | 11/2010 | Wu et al. | |
| 2010/0323937 | A1* | 12/2010 | Wu et al. | 508/591 |
| 2011/0082061 | A1 | 4/2011 | Carey et al. | |
| 2011/0082063 | A1 | 4/2011 | Carey et al. | |
| 2011/0136714 | A1* | 6/2011 | Haigh et al. | 508/583 |

FOREIGN PATENT DOCUMENTS

| | | | |
|---|---|---|---|
| EP | 0088453 | B1 | 5/1987 |
| EP | 0276320 | B1 | 8/1988 |
| EP | 0277004 | A1 | 8/1988 |
| EP | 0277007 | B1 | 8/1988 |
| EP | 0284708 | B1 | 10/1988 |
| EP | 0291006 | B1 | 11/1988 |
| EP | 0321852 | B1 | 6/1989 |
| EP | 0349276 | B1 | 1/1990 |
| EP | 0377306 | B1 | 7/1990 |
| EP | 0403866 | A1 | 12/1990 |
| EP | 0513380 | B1 | 11/1992 |
| EP | 0680942 | A1 | 5/1994 |
| EP | 0613873 | A2 | 9/1994 |
| EP | 0930320 | A1 | 7/1997 |
| EP | 1028128 | A1 | 10/1997 |
| EP | 0992517 | A2 | 9/1998 |
| EP | 1309633 | B1 | 8/2000 |
| EP | 1308496 | B1 | 5/2003 |
| EP | 1342707 | A2 | 9/2003 |
| EP | 1607415 | A1 | 12/2005 |
| EP | 1661921 | A1 | 5/2006 |
| GB | 938069 | | 9/1963 |
| IN | 191553 | | 12/2003 |
| JP | 6336590 | A | 12/1994 |
| JP | 200500446 | A | 7/2005 |
| WO | 9623751 | | 8/1996 |
| WO | 9804658 | | 2/1998 |
| WO | 9967347 | | 6/1999 |
| WO | 9964543 | | 12/1999 |
| WO | 0058423 | | 10/2000 |
| WO | 0214384 | A2 | 2/2002 |
| WO | 02083826 | A1 | 10/2002 |
| WO | 03009136 | A1 | 1/2003 |
| WO | 03020856 | A1 | 3/2003 |
| WO | 03051943 | A1 | 6/2003 |
| WO | 03071369 | A1 | 8/2003 |
| WO | 03104292 | A1 | 12/2003 |
| WO | 2004046214 | A2 | 6/2004 |
| WO | 2004053030 | A2 | 6/2004 |
| WO | 2005111178 | A1 | 12/2005 |
| WO | 2006071595 | A2 | 7/2006 |
| WO | 2006083632 | A1 | 8/2006 |
| WO | 2007/011832 | A1 | 1/2007 |
| WO | 2007005094 | A1 | 1/2007 |
| WO | 2007011459 | A1 | 1/2007 |
| WO | 2007011462 | A1 | 1/2007 |
| WO | 2007145924 | A1 | 12/2007 |
| WO | 2007146081 | A1 | 12/2007 |
| WO | 2008010865 | A2 | 1/2008 |
| WO | 2008011338 | A2 | 1/2008 |
| WO | 2008102114 | A1 | 8/2008 |
| WO | 2009017953 | A2 | 2/2009 |
| WO | 2009/123800 | A1 | 10/2009 |
| WO | 2009137264 | A1 | 11/2009 |

OTHER PUBLICATIONS

S. T. Orszulik, "Chemistry and Technology of Lubricants, Passage", Jan. 1, 1992, pp. 243-245.

J. Brennan, "Wide-Temperature Range Synthetic Hydrocarbon Fluids", Ind. Eng. Chem. Prod. Res. Dev., 1980, vol. 19, pp. 2-6.

K. Denbigh, "The Kinetics of Continuous Reaction Processes: Application to Polymerization", J. Applied Chem, 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.

G. Gokel, ed., "Dean's Handbook of Organic Chemistry", 2nd Edition, McGraw-Hill, 2004, available on-line at hhtp://knovel.com.

M. LeVan, et al., "Adsorption and Ion Exchange", Perry's Chemical Engineer's Handbook, 7th ed., 1997, pp. 16-1-16-66.

O. Levenspiel, "Ch. 7: Design for Multiple Reactions", Chemical Reaction Engineering, 2nd ed., 1972, pp. 196-209.

N. Naga, et al., "Effect of Co-Catalyst System on a-Olefin Polymerization with Rac- and Meso-[Dimethylsilylenebis (2,3,5-Trimethyl-Cyclopentadienyl)] Zirconium Dichloride", Macromol. Rapid Commun., 1997, vol. 18, pp. 581-589.

N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200, pp. 1587-1594.

F. Rodriguez, "The Molecular Weight of Polymers", Principles of Polymer Systems, 1970, Chapter 6, pp. 115-144.

M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.

(56) References Cited

OTHER PUBLICATIONS

T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.
J. Wills, "Synthetic Lubricants", Lubrication Fundamentals, Marcel Dekker Inc., New York, 1980, pp. 75-80.
"Mobil Releases SuperSyn PAO's", Lubrication Engineers, 1999, vol. 55, Part 8, pp. 45.
TIBA data, "TIBA datasheet" available on-line at www.albermarle.com on Aug. 26, 2010.
ASTM D3427-03, "Standard Test Method for Air Release Properties of Petroleum Oils".
http://www.mobil.com/USA, Mobilgear®SHC XMP Series.
http://www.famm11c.com/famm/lubricant_product.asp?gearoils&& wPinnacleMarineGear220, Pinnacle® Marine Gear 220.
Rudnick, Leslie R., "Synthetics, Mineral Oils, and Bio-Based Lubricants Chemistry and Technology", published by CRC Press, Taylor & Francis Group, 2006, 37-46.
Corsico, G., et al., "Poly(internal olefins)", EURON, Milan, Italy, Chemical Industries (Dekker), 1999, 77(Synthetic Lubricants and High-Performance Functional Fluids, 2nd Edition, 53-62.
Kirk-Othmer Encyclopedia of Chemcial Technology, Second completely revised edition, "Diamines and Higher Amines, Aliphatic", vol. 7, 1965, published by John Wiley & Sons, Inc., 22-39.

* cited by examiner

METHOD FOR IMPROVING THE FUEL EFFICIENCY OF ENGINE OIL COMPOSITIONS FOR LARGE LOW AND MEDIUM SPEED ENGINES BY REDUCING THE TRACTION COEFFICIENT

This application claims benefit of U.S. Provisional Application No. 61/337,182 filed Feb. 1, 2010.

BACKGROUND OF THE INVENTION

1. Field of the Invention

The present invention relates to the operation of large low and medium speed engines using lubricating oil formulations.

2. Description of the Related Art

Diesel engines designed for marine and stationary power applications can be either 2-stroke or 4-stroke cycle having up to 20 cylinders and are typically classified as low-speed, medium-speed or high-speed diesel engines. These engines burn a wide variety of fuels ranging from residual or heavy fuel oils to natural gas (diesel compression or spark-ignited) and are most commonly used for marine propulsion, marine auxiliary (vessel electricity generation), distributed power generation and combined heating and power (CHP). Spark ignition engines fueled by natural gas are most commonly used for natural gas compression at the well heads and along natural gas pipelines, for combined heat and power (CHP) and for distributed power and normally run continuously near full load conditions, shutting down only for maintenance or oil changes. Lubrication of marine engines can be all-loss (i.e., lubricant fed directly to the cylinder by cylinder oil), whereas lubrication of both marine and gas engines are typically recirculation involving oil sumps. Lubrication of critical engine parts includes piston rings, cylinder liners, bearings, piston cooling, fuel pump, engine control hydraulics, etc. Fuel is typically the major cost of operating marine diesel engines and a typical 12 cylinder, 90 cm bore low-speed diesel engine used in marine vessel container service will burn approximately $33M of heavy fuel per year at today's price of $480/MT. Therefore, a fuel efficiency gain of as little as 1% would result in approximately up to an annual savings of $330K to the ship operator. In addition, governmental organizations, such as the International Marine Organization, U.S. Environmental Protection Agency and the California Air Resources Board are legislating emissions requirements for these engines Improving fuel efficiency will reduce emissions ($CO_2$, $SO_x$, $No_x$ and Particulate Matter) commensurately which should result in some emissions credit trading value.

Because the lubricant is subjected to a constant high temperature environment, the life of the lubricant is often limited by its oxidation stability. Moreover, because natural gas-fired engines run with high emission of nitrogen oxides ($NO_x$), the lubricant life may also be limited by its nitration resistance. A longer term requirement is that the lubricant must also maintain cleanliness within the high temperature environment of the engine, especially for critical components such as the piston and piston rings. Therefore, it is desirable for the lubricants for these engine to have good cleanliness qualities while promoting long life through enhanced resistance to oxidation and nitration.

Gas engine oil of enhanced life as evidenced by an increase in the resistance of the oil to oxidation, nitration and deposit formation is the subject of U.S. Pat. No. 5,726,133. The gas engine oil of that patent is a low ash gas engine oil comprising a major amount of a base oil of lubricating viscosity and a minor amount of an additive mixture comprising a mixture of detergents comprising at least one alkali or alkaline earth metal salt having a Total Base Number (TBN) of about 250 and less and a second alkali or alkaline earth metal salt having a TBN lower than the aforesaid component. The TBN of this second alkali or alkaline earth metal salt will typically be about half or less that of the aforesaid component.

The fully formulated gas engine oil of U.S. Pat. No. 5,726,133 can also typically contain other standard additives known to those skilled in the art, including dispersants (about 0.5 to 8 vol %), phenolic or aminic anti-oxidants (about 0.05 to 1.5 vol %), metal deactivators such as triazoles, alkyl-substituted dimercaptothiadiazoles (about 0.01 to 0.2 vol %), anti-wear additives such as metal dithiophosphates, metal dithiocarbamates, metal xanthates or tricresylphosphates (about 0.05 to 1.5 vol %), pour point depressants such as poly (meth) acrylates or alkyl aromatic polymers (about 0.05-0.6 vol %), anti-foamants such as silicone anti-foaming agents (about 0.005 to 0.15 vol %) and viscosity index improvers, such as olefin copolymers, polymethacrylates, styrene-diene block copolymers, and star copolymers (up to about 15 vol %, preferably up to about 10 vol %).

U.S. Pat. No. 6,191,081 is directed to a lubricating oil composition for natural gas engines comprising a major amount of a base oil of lubricating viscosity and a minor amount of a mixture of one or more metal salicylate detergents and one or more metal phenate(s) and/or metal sulfonate detergents.

The lubricating oil base stock is any natural or synthetic lubricating base oil stock fraction typically having a kinematic viscosity at 100° C. of about 5 to 20 cSt. In a preferred embodiment, the use of the viscosity index improver permits the omission of oil of viscosity about 20 cSt or more at 100° C. from the lube base oil fraction used to make the present formulation. Therefore, a preferred base oil is one which contains little, if any, heavy fraction; e.g., little, if any, lube oil fraction of viscosity 20 cSt or higher at 100° C.

The lubricating oil base stock can be derived from natural lubricating oils, synthetic lubricating oils or mixtures thereof. Suitable base stocks include those in API categories I, II and III, where saturates level and Viscosity Index are:

Group I—less than 90% and 80-120, respectively;

Group II—greater than 90% and 80-120, respectively; and

Group III—greater than 90% and greater than 120, respectively.

Suitable lubricating oil base stocks include base stocks obtained by isomerization of synthetic wax and slack wax, as well as hydrocrackate base stocks produced by hydrocracking (rather than solvent extracting) the aromatic and polar components of the crude.

The mixture of detergents comprises a first metal salt or group of metal salts selected from the group consisting of one or more metal sulfonates(s), salicylate(s), phenate(s) and mixtures thereof having a high TBN of greater than about 150 to 300 or higher, used in an amount in combination with the other metal salts or groups of metal salts (recited below) sufficient to achieve a lubricating oil of at least 0.65 wt % sulfated ash content, a second metal salt or group of metal salts selected from the group consisting of one or more metal salicylate(s), metal sulfonate(s), metal phenate(s) and mixtures thereof having a medium TBN of greater than about 50 to 150, and a third metal salt or group of metal salts selected from the group consisting of one or more metal sulfonate(s), metal salicylate(s) and mixtures thereof identified as neutral or low TBN, having a TBN of about 10 to 50, the total amount of medium plus neutral/low TBN detergent being about 0.7 vol % or higher (active ingredient), wherein at least one of the medium or low/neutral TBN detergent(s) is metal salicylate, preferably at least one of the medium TBN detergent(s) is a metal salicylate. The total amount of high TBN detergents is about 0.3 vol % or higher (active ingredient). The mixture contains salts of at least two different types, with medium or neutral salicylate being an essential component. The volume ratio (based on active ingredient) of the high TBN detergent to medium plus neutral/low TBN detergent is in the range of about 0.15 to 3.5.

The mixture of detergents is added to the lubricating oil formulation in an amount up to about 10 vol % based on active ingredient in the detergent mixture, preferably in an amount up to about 8 vol % based on active ingredient, more preferably 6 vol % based on active ingredient in the detergent mixture, most preferably between about 1.5 to 5.0 vol %, based on active ingredient in the detergent mixture. Preferably, the total amount of metal salicylate(s) used of all TBNs is in the range of between 0.5 vol % to 4.5 vol %, based on active ingredient of metal salicylate.

U.S. Published Application US2005/0059563 is directed to a lubricating oil composition, automotive gear lubricating composition and fluids useful in the preparation of finished automotive gear lubricants and gear oil comprising a blend of a PAO having a viscosity of between about 40 cSt ($mm^2/s$) and 1000 cSt ($mm^2/s$) @ 100° C., and an ester having a viscosity of less than or equal to about 2.0 cSt ($mm^2/s$) @ 100° C. wherein the blend of PAO and ester has a viscosity index greater than or equal to the viscosity index of the PAO. The composition may further contain thickeners, anti-oxidants, inhibitor packages, anti-rust additives, dispersants, detergents, friction modifiers, traction improving additives, demulsifiers, defoamants, dyes and haze inhibitors.

US Published Application 2006/0276355 is directed to a lubricant blend for enhanced micropitting properties wherein the lubricant comprises at least two base stocks with a viscosity difference between the first and second base stock of greater than 96 cSt ($mm^2/s$) @ 100° C. At least one base stock is a polyalpha olefin with a viscosity of less than 6 cSt ($mm^2/s$) but greater than 2 cSt ($mm^2/s$), and the second base stock is a synthetic oil with a viscosity greater than 100 cSt ($mm^2/s$) but less than 300 cSt ($mm^2/s$) @ 100° C. The second base stock can be a high viscosity polyalpha olefin.

U.S. Published Application 2007/0289897 is directed to a lubricating oil blend comprising at least two base stocks with a viscosity difference between the first and second base stock of greater than 96 cSt ($mm^2/s$) @ 100° C., the lubricant exhibiting improved air release. The blend contains at least one synthetic PAO having a viscosity of less than 10 cSt ($mm^2/s$) but greater than 2 cSt ($mm^2/s$) @ 100° C. and a second synthetic oil having a viscosity greater than 100 cSt ($mm^2/s$) but less than 300 cSt ($mm^2/s$) @ 100° C. The lubricant can contain anti-wear, anti-oxidant, defoamant, demulsifier, detergent, dispersant, metal passivator, friction reducer, rust inhibitor additive and mixtures thereof.

U.S. Published Application 2007/0298990 is directed to a lubricating oil comprising at least two base stocks, the first base stock has a viscosity greater than 40 cSt ($mm^2/s$) @ 100° C. and a molecular weight distribution (MWD) as a function of viscosity at least 10% less than algorithm:

$$MWD=0.2223+1.0232*\log(Kv \text{ at } 100^\circ \text{ C. in cSt})$$

and a second base stock with a viscosity less than 10 cSt ($mm^2/s$) @ 100° C. Preferably the difference in viscosity between the first and second stocks is greater than 30 cSt ($mm^2/s$) @ 100° C. Preferably the first high viscosity stock is a metallocene catalyzed PAO base stock. The second stock can be selected from GTL lubricants, wax-derived lubricants, PAO, brightstock, brightstock with PIB, Group I base stocks, Group II base stocks, Group III base stocks and mixtures thereof. The lubricant can contain additives including detergents. Preferably the first stock has a viscosity of greater than 300 cSt ($mm^2/s$) @ 100° C., the second stock has a viscosity of between 1.5 cSt ($mm^2/s$) to 6 cSt ($mm^2/s$) @ 100° C. Preferably the difference in viscosity between the first and second stocks is greater than 96 cSt ($mm^2/s$) @ 100° C.

U.S. Published Application US2008/0207475 is directed to a lubricating oil comprising at least two base stocks, the first base stock having a viscosity of at least 300 cSt ($mm^2/s$) @ 100° C. and a molecular weight distribution (MSD) as a function of viscosity at least 10% less than algorithm:

$$MWD=0.2223+1.0232*\log(KV \text{ @}100^\circ \text{ C. in cSt})$$

and the second stock has a viscosity of less than 100 cSt ($mm^2/s$) @ 100° C. Preferably the difference in viscosity between the first and second stocks is greater than 250 cSt ($mm^2/s$) @ 100° C. Preferably the first high kinematic viscosity stock is a metallocene catalyzed PAO base stock. The second stock can be chosen from GTL base stock, wax-derived base stock, PAO, brightstock, brightstock with PIB, Group I base stock, Group II base stock, Group III base stock, Group V base stock, Group VI base stock and mixtures thereof. The lubricant can contain additives including detergents.

U.S. Pat. No. 6,140,281 is directed to long life gas engine lubricating oils containing detergents. The lubricating oil comprises a major amount of a base oil of lubricating viscosity and a minor amount of a mixture of one or more metal sulfonate(s) and/or phenate(s) and one or more metal salicylate(s) detergents, all detergents in the mixture having the same or substantially the same Total Base Number (TBN).

The lubricating oil base stock is any natural or synthetic lubricating base stock fraction typically having a kinematic viscosity at 100° C. of about 5 to 20 cSt, more preferably about 7 to 16 cSt, most preferably about 9 to 13 cSt. In a preferred embodiment, the use of the viscosity index improver permits the omission of oil of viscosity 20 cSt or more at 100° C. from the lube base oil fraction used to make the present formulation. Therefore, a preferred base oil is one which contains little, if any, heavy fractions; e.g., little, if any, lube oil fraction of viscosity 20 cSt or higher at 100° C.

The lubricating oil base stock can be derived from natural lubricating oils, synthetic lubricating oils or mixtures thereof. Suitable base stocks include those in API categories I, II and III, where saturates level and Viscosity Index are:

Group I—less than 90% and 80-120, respectively;

Group II—greater than 90% and 80-120, respectively; and

Group III—greater than 90% and greater than 120, respectively.

Suitable lubricating oil base stocks include base stocks obtained by isomerization of synthetic wax and slack wax, as well as hydrocrackate base stocks produced by hydrocracking (rather than solvent extracting) the aromatic and polar components of the crude.

The detergent is a mixture of one or more metal sulfonate(s) and/or metal phenate(s) with one or more metal salicylate(s). The metals are any alkali or alkaline earth metals; e.g., calcium, barium, sodium, lithium, potassium, magnesium, more preferably calcium, barium and magnesium. It is a feature of the lubricating oil that each of the metal salts used in the mixture has the same or substantially the same TBN as the other metal salts in the mixture.

U.S. Pat. No. 6,645,922 is directed to a lubricating oil for two-stroke cross-head marine diesel engines comprising a base oil and an oil-soluble overbased detergent additive in the form of a complex wherein the basic material of the detergent is stabilized by more than one surfactant. The more than one surfactants can be mixtures of: (1) sulfurized and/or non-sulfurized phenols and one other surfactant which is not a phenol surfactant; (2) sulfurized and/or non-sulfurized salicylic acid and one other surfactant which is not a salicylic surfactant; or (3) at least three surfactants which are sulfurized or non-sulfurized phenol, sulfurized or non-sulfurized salicylic acid and one other surfactant which is not a phenol or salicylic surfactant; or (4) at least three surfactants which are sulfurized or non-sulfurized phenol, sulfurized or non-sulfurized salicylic acid and at least one sulfuric acid surfactant.

The base stock is an oil of lubricating viscosity and may be any oil suitable for the system lubrication of a cross-head engine. The lubricating oil may suitably be an animal, vegetable or a mineral oil. Suitably the lubricating oil is a petroleum-derived lubricating oil, such as naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example, liquid polyisobutene and polyalpha olefins. Commonly, a mineral oil is employed. The lubricating oil may generally comprise greater than 60, typically greater than 70% by mass of the lubricating oil composition and typically have a kinematic viscosity at 100° C. of from 2 to 40, for example, from 3 to 15, $mm^2/s$, and a viscosity index from 80 to 100, for example, from 90 to 95.

Another class of lubricating oil is hydrocracked oils, where the refining process further breaks down the middle and heavy distillate fractions in the presence of hydrogen at high temperatures and moderate pressures. Hydrocracked oils typically have kinematic viscosity at 100° C. of from 2 to 40, for example, from 3 to 15, $mm^2/s$, and a viscosity index typically in the range of from 100 to 110, for example, from 105 to 108.

Brightstock refers to base oils which are solvent-extracted, de-asphalted products from vacuum residuum generally having a kinematic viscosity at 100° C. from 28 to 36 $mm^2/s$, and are typically used in a proportion of less than 30, preferably less than 20, more preferably less than 15, most preferably less than 10, such as less than 5 mass %, based on the mass of the lubricating oil composition.

U.S. Pat. No. 6,613,724 is directed to gas fueled engine lubricating oil comprising an oil of lubricating viscosity, a detergent including at least one calcium salicylate having a TBN in the range 70 to 245, 0 to 0.2 mass % of nitrogen, based on the mass of the oil composition, of a dispersant and minor amounts of one or more co-additive. The base oil can be any animal, vegetable or mineral oil or synthetic oil. The base oil is used in a proportion of greater than 60 mass % of the composition. The oil typically has a viscosity at 100° C. of from 2 to 40, for example 3 to 15 $mm^2/s$ and a viscosity index of from 80 to 100. Hydrocracked oils can also be used which have viscosities of 2 to 40 $mm^2/s$ at 100° C. and viscosity indices of 100 to 110. Brightstock having a viscosity at 100° C. of from 28 to 36 $mm^2/s$ can also be used, typically in a proportion less than 30, preferably less than 20, most preferably less than 5 mass %.

U.S. Pat. No. 7,101,830 is directed to a gas engine oil having a boron content of more than 95 ppm comprising a major amount of a lubricating oil having a viscosity index of 80 to 120, at least 90 mass % saturates, 0.03 mass % or less sulfur and at least one detergent. Metal salicylate is a preferred detergent.

U.S. Pat. No. 4,956,122 is directed to a lubricating oil composition containing a high viscosity synthetic hydrocarbon such as high viscosity PAO, liquid hydrogenated polyisoprenes, or ethylene-alpha olefin copolymers having a viscosity of 40-1000 cSt ($mm^2/s$) at 100° C., a low viscosity synthetic hydrocarbon having a viscosity of between 1 and 10 cSt ($mm^2/s$) at 100° C., optionally a low viscosity ester having a viscosity of between 1 and 10 cSt ($mm^2/s$) at 100° C. and optionally up to 25 wt % of an additive package.

DESCRIPTION OF THE INVENTION

Figure 1:
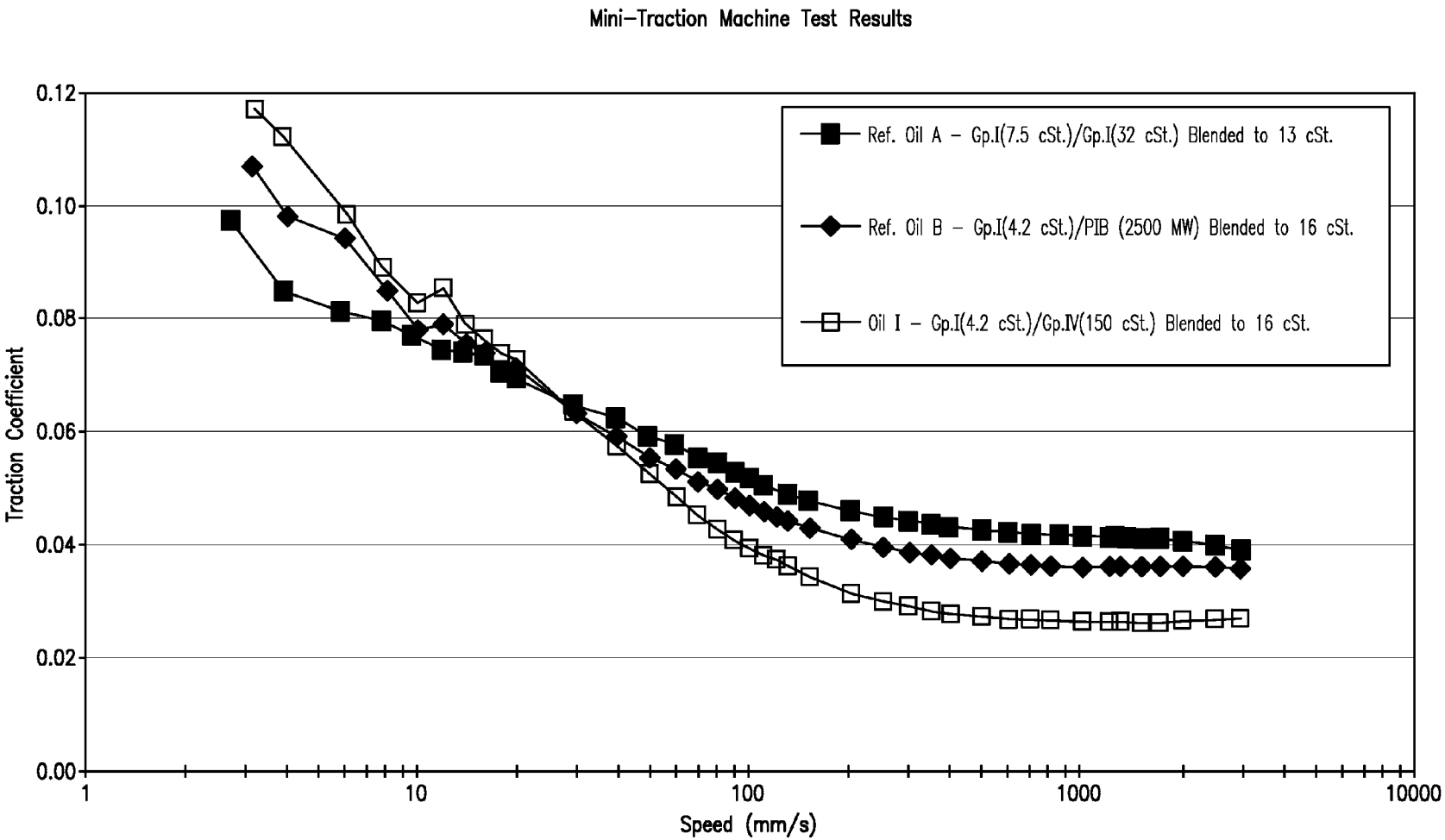
FIG. 1 presents the effect on traction coefficient exhibited by a blend of a low KV Group I oil with a high KV Group IV oil compared to reference oils which are either a blend of two low KV Group I oils or a blend of a low KV Group I oil with PIB (polyisobutylene).

The invention is directed to a method for improving the fuel economy of large low and medium speed engines in which the interfacing surface speeds reach at least 3 mm/s, preferably of at least 30 mm/s, more preferably at least 50 mm/s This is achieved by lubricating said engines using an oil of reduced traction coefficient, said lubricating oil comprising a base oil comprising a bimodal blend of two different base oils, the first base oil being one or more low kinematic viscosity oils selected from the group consisting of Group I, Group II, Group III, Group IV or Group V base oils preferably Group I, Group II, Group III or Group IV, more preferably Group I, Group II or Group III, still more preferably Group III or Group IV base oils having a kinematic viscosity at 100° C. of from 2 to 12 cSt ($mm^2/s$) and a second base oil selected from one or more oils selected from Group IV base oils having a kinematic viscosity at 100° C. of at least 38 cSt ($mm^2/s$), the difference in kinematic viscosity between the first and second base oils of the blend being at least 30 cSt ($mm^2/s$), the combination of the first and second base oils having a kinematic viscosity at 100° C. of 20 cSt ($mm^2/s$) or less, wherein the improvement in fuel economy is evidenced by the traction coefficient of the engine oil employing the bimodal blend being lower than the traction coefficient of engine oils which are not bimodal or which are not bimodal to the same degree as recited above or which are based on mixtures of two or more Group I base stocks or mixtures of two or more Group II base stocks, or mixtures of Group I and Group II base stocks. As employed herein and in the appended claims the terms "base stock" and "base oil" are used synonymously and interchangeably.

This invention is also directed to a method for improving the fuel economy of large low and medium speed engines that reach surface speeds of at least about 3 mm/s, preferably of at least 30 mm/s, more preferably at least 50 mm/s, and are lubricated by an engine oil by reducing the traction coefficient of the engine oil used to lubricate the engine, by employing as the engine oil a lubricating oil comprising a first base oil selected from the group consisting of a Group I, Group II, Group III, Group IV or Group V base oil having a kinematic viscosity at 100° C. of from 2 to 12 $mm^2/s$ and a second base oil selected from Group IV base oils having a kinematic viscosity at 100° C. of at least 38 $mm^2/s$, the difference in kinematic viscosity between the first and second base oils being at least 30 $mm^2/s$, the combination of the first and second base oils having a kinematic viscosity at 100° C. of 25 $mm^2/s$ or less, wherein the improvement in fuel economy is evidenced by the engine oil having a traction coefficient which is lower than the traction coefficient of an engine oil of the same kinematic viscosity at 100° C. comprising a single base oil component of a Group I, Group II, Group III, Group IV or Group V base oil or a blend of comparable base oils having a difference in kinematic viscosity between a first and second base oil less than 30 $mm^2/s$ or which are based on mixtures of two or more Group I base oils or mixtures of two or more Group II base oils or mixtures of Group I and Group II base oils.

Preferably the difference in viscosity between the first and second base stocks is at least 34 cSt ($mm^2/s$), more preferably at least 110 cSt ($mm^2/s$), still more preferably at least 140 cSt ($mm^2/s$).

The combination of the first and second base stocks preferably has a kinematic viscosity at 100° C. of at least 25 $mm^2/s$ or less, more preferably of 20 $mm^2/s$ or less, and most preferably 16 $mm^2/s$ or less.

By "surface speed" is meant the velocity at which interfacing surfaces of an engine, e.g. piston and cylinder wall, interfacing bearing surfaces, etc. move past each other when the engine is operating. This surface speed is a primary factor in influencing whether the lubrication regime for the interfacing surfaces is boundary, hydrodynamic or mixed (boundary/hydrodynamic).

The method of the present invention utilizes a bimodal mixture of base stocks. By bimodal in the present specification is meant a mixture of at least two base stocks each having a different kinematic viscosity at 100° C. wherein the difference in kinematic viscosity at 100° C. between the at least two base stocks in the bimodal blend is at least 30 $mm^2/s$. The mixture of at least two base stocks comprises one or more low kinematic viscosity base stock(s) having a kinematic viscosity at 100° C. of from 2 to 12 $mm^2/s$, which base stock is selected from the group consisting of Group I, Group II, Group III, Group IV and Group V base stocks using the API classification in combination with one or more high kinematic viscosity Group IV base stocks having a kinematic viscosity at 100° C. of at least 38 $mm^2/s$.

Group I base stocks are conventional oil stocks classified by the American Petroleum Institute (API) as oils containing less than 90% saturates, greater than 0.03 wt % sulfur and a viscosity index greater than or equal to 80 and less than 120.

Group II base stocks are classified by the American Petroleum Institute as oils containing greater than or equal to 90% saturates, less than or equal to 0.03 wt % sulfur and a viscosity index greater than or equal to 80 and less than 120.

Group III base stocks are classified by the American Petroleum Institute as oils containing greater than or equal to 90% saturates, less than or equal to 0.03 wt % sulfur and a viscosity index of greater than or equal to 120. Group III base stocks are usually produced using a three-stage process involving hydrocracking an oil feed stock, such as vacuum gas oil, to remove impurities and to saturate all aromatics which might be present to produce highly paraffinic lube oil stock of very high viscosity index, subjecting the hydrocracked stock to selective catalytic hydrodewaxing which converts normal paraffins into branched paraffins by isomerization followed by hydrofinishing to remove any residual aromatics, sulfur, nitrogen or oxygenates.

Group III stocks also embrace non-conventional or unconventional base stocks and/or base oils which include one or a mixture of base stock(s) and/or base oil(s) derived from: (1) one or more Gas-to-Liquids (GTL) materials; as well as (2) hydrodewaxed, or hydroisomerized/cat (and/or solvent) dewaxed base stock(s) and/or base oil(s) derived from synthetic wax, natural wax or waxy feeds, waxy feeds including mineral and/or non-mineral oil waxy feed stocks such as gas oils, slack waxes (derived from the solvent dewaxing of natural oils, mineral oils or synthetic; e.g., Fischer-Tropsch feed stocks) and waxy stocks such as waxy fuels hydrocracker bottoms, waxy raffinate, hydrocrackate, thermal crackates, foots oil or other mineral, mineral oil, or even non-petroleum oil derived waxy materials such as waxy materials recovered from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (and/or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions combined with one, two or more higher viscosity fractions to produce a blend wherein the blend exhibits a target kinematic viscosity in the range of 2 to 12 $mm^2/s$ at 100° C.

The GTL material, from which the GTL base stock(s) and/or base oil(s) is/are derived is preferably an F-T material (i.e., hydrocarbons, waxy hydrocarbons, wax).

The GTL material from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

Useful compositions of GTL base stock(s) and/or base oil(s), hydrodewaxed or hydroisomerized/cat (and/or solvent) dewaxed F-T material derived base stock(s), and wax-derived hydrodewaxed, or hydroisomerized/cat (and/or solvent) dewaxed base stock(s), such as wax isomerates or hydrodewaxates, are recited in U.S. Pat. Nos. 6,080,301; 6,090,989, and 6,165,949, for example.

Base stock(s) and/or base oil(s) derived from waxy feeds, which are also suitable for use as the Group III stocks in this invention, are paraffinic fluids of lubricating viscosity derived from hydrodewaxed, or hydroisomerized/cat (and/or solvent) dewaxed waxy feed stocks of mineral oil, non-mineral oil, non-petroleum, or natural source origin, e.g. feed stocks such as one or more of gas oils, slack wax, waxy fuels hydrocracker bottoms, hydrocarbon raffinates, natural waxes, hydrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stock(s) and/or base oil(s).

Slack wax is the wax recovered from any waxy hydrocarbon oil including synthetic oil such as F-T waxy oil or petroleum oils by solvent or auto-refrigerative dewaxing. Solvent dewaxing employs chilled solvent such as methyl ethyl ketone (MEK), methyl isobutyl ketone (MIBK), mixtures of MEK/MIBK, mixtures of MEK and toluene, while auto-refrigerative dewaxing employs pressurized, liquefied low boiling hydrocarbons such as propane or butane.

Slack waxes secured from synthetic waxy oils such as F-T waxy oil will usually have zero or nil sulfur and/or nitrogen containing compound content. Slack wax(es) secured from petroleum oils, may contain sulfur and nitrogen-containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The process of making the lubricant oil base stocks from waxy stocks, e.g. slack wax, F-T wax or waxy feed, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst.

Following any needed hydrodenitrogenation or hydrosulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, Offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

Conversion of the waxy feed stock may be conducted over a combination of Pt/zeolite beta and Pt/ZSM-23 catalysts or over such catalysts used in series in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over a catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269.

A dewaxing step, when needed, may be accomplished using one or more of solvent dewaxing, catalytic dewaxing or hydrodewaxing processes or combinations of such processes in any sequence.

In solvent dewaxing, the hydroisomerate may be contacted with chilled solvents such as acetone, methyl ethyl ketone (MEK), methyl isobutyl ketone (MIBK), mixtures of ME/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Auto-refrigerative dewaxing using low molecular weight hydrocarbons, such as propane, can also be used in which the hydroisomerate is mixed with, e.g., liquid propane, at least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention.

In catalytic dewaxing the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials which are separated from the heavier base stock fraction. This base stock fraction can then be fractionated into two or more base stocks. Separation of the lower boiling material may be accomplished either prior to or during fractionation of the heavy base stock fraction material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPOs. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400 to 600° F., a pressure of 500 to 900 psig, $H_2$ treat rate of 1500 to 3500 SCF/B for flow-through reactors and LHSV of 0.1 to 10, preferably 0.2 to 2.0. The dewaxing is typically conducted to convert no more than 40 wt % and preferably no more than 30 wt % of the hydroisomerate having an initial boiling point in the range of 650 to 750° F. to material boiling below its initial boiling point.

The first base stock of the bimodal mixture can also be a Group IV base stock which for the purposes of this specification and the appended claims is identified as polyalpha olefins.

The polyalpha olefins (PAOs) in general are typically comprised of relatively low molecular weight hydrogenated polymers or oligomers of polyalphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins.

The PAO fluids may be conveniently made by the polymerization of an alphaolefin in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl proprionate. For example, the methods disclosed by U.S. Pat. No. 4,149,178 or U.S. Pat. No. 3,382,291 may be conveniently used herein. Other descriptions of PAO synthesis are found in the following U.S. patents: U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The PAOs useful in the present invention can also be made by metallocene catalysis. The metallocene-catalyzed PAO (mPAO) can be a copolymer made from at least two alphaolefins or more, or a homo-polymer made from a single alphaolefin feed by a metallocene catalyst system.

The metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion. mPAO and methods for producing mPAO employing metallocene catalysis are described in WO 2009/123800, WO 2007/011832 and U.S. Published Application 2009/0036725.

The copolymer mPAO composition is made from at least two alphaolefins of $C_3$ to $C_{30}$ range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers of the invention can be isotactic, atactic, syndiotactic polymers or any other form of appropriate taciticity. These copolymers have narrow molecular weight distributions and excellent lubricating properties.

mPAO can also be made from mixed feed Linear Alpha Olefins (LAOs) comprising at least two and up to 26 different linear alphaolefins selected from $C_3$ to $C_{30}$ linear alphaolefins. Mixed feed LAO is obtained from an ethylene growth processing using an aluminum catalyst or a metallocene catalyst. The growth olefins comprise mostly $C_6$ to $C_{18}$ LAO. LAOs from other processes can also be used.

The homo-polymer mPAO composition is made from single alphaolefin choosing from $C_3$ to $C_{30}$ range, preferably $C_3$ to $C_{16}$, most preferably $C_3$ to $C_{14}$ or $C_3$ to $C_{12}$. The homo-polymers can be isotactic, atactic, syndiotactic polymers or any other form of appropriate taciticity. The taciticity can be carefully tailored by the polymerization catalyst and polymerization reaction condition chosen or by the hydrogenation condition chosen.

The alphaolefin(s) can be chosen from any component from a conventional LAO production facility or from a refinery. It can be used alone to make homo-polymer or together with another LAO available from a refinery or chemical plant, including propylene, 1-butene, 1-pentene, and the like, or with 1-hexene or 1-octene made from a dedicated production facility. In another embodiment, the alphaolefins can be chosen from the alphaolefins produced from Fischer-Tropsch synthesis (as reported in U.S. Pat. No. 5,382,739). For example, $C_3$ to $C_{16}$ alphaolefins, more preferably linear alphaolefins, are suitable to make homo-polymers. Other combinations, such as $C_4$- and $C_{14}$-LAO, $C_6$- and $C_{16}$-LAO, $C_8$-, $C_{10}$-, $C_{12}$-LAO, or $C_8$- and $C_{14}$-LAO, $C_6$-, $C_{10}$-, $C_{14}$-LAO, $C_4$- and $C_{12}$-LAO, etc., are suitable to make copolymers.

A feed comprising a mixture of LAOs selected from $C_3$ to $C_{30}$ LAOs or a single LAO selected from $C_3$ to $C_{16}$ LAO, is contacted with an activated metallocene catalyst under oligomerization conditions to provide a liquid product suitable for use in lubricant components or as functional fluids. Also embraced are copolymer compositions made from at least two alphaolefins of $C_3$ to $C_{30}$ range and having monomers randomly distributed in the polymers. The phrase "at least two alphaolefins" will be understood to mean "at least two different alphaolefins" (and similarly "at least three alphaolefins" means "at least three different alphaolefins", and so forth).

The product obtained is an essentially random liquid copolymer comprising the at least two alphaolefins. By "essentially random" is meant that one of ordinary skill in the art would consider the products to be random copolymer. Likewise the term "liquid" will be understood by one of ordinary skill in the art as meaning liquid under ordinary conditions of temperature and pressure.

The process employs a catalyst system comprising a metallocene compound (Formula 1, below) together with an activator such as a non-coordinating anion (NCA) (Formula 2, below) or methylaluminoxane (MAO) 1111 (Formula 3, below):

Formula 1

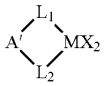

Formula 2

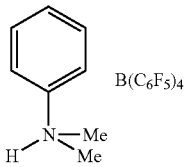

NCA

Formula 3

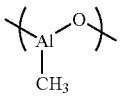

MAO

The term "catalyst system" is defined herein to mean a catalyst precursor/activator pair, such as a metallocene/activator pair. When "catalyst system" is used to describe such a pair before activation, it means the unactivated catalyst (precatalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkyl aluminum compound, is also used as an impurity scavenger.

The metallocene is selected from one or more compounds according to Formula 1 above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated. A is an optional bridging group which, if present, in preferred embodiments is selected from dialkylsilyl, dialkylmethyl, diphenylsilyl or diphenylmethyl, ethylenyl (—$CH_2$—$CH_2$), alkylethylenyl (—$CR_2$—$CR_2$), where alkyl can be independently $C_1$ to $C_{16}$ alkyl radical or phenyl, tolyl, xylyl radical and the like, and wherein each of the two X groups, Xa and Xb, are independently selected from halides OR(R is an alkyl group, preferably selected from $C_1$ to $C_5$ straight or branched chain alkyl groups), hydrogen, $C_1$ to $C_{16}$ alkyl or aryl groups, haloalkyl, and the like. Usually relatively more highly substituted metallocenes give higher catalyst productivity and wider product viscosity ranges and are thus often more preferred.

The polyalphaolefins preferably have a Bromine number of 1.8 or less as measured by ASTM D1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less. If necessary the PAO can be hydrogenated to achieve a low bromine number.

The mpolyalphaolefins (mPAO) described herein may have monomer units represented by Formula 4 in addition to the all regular 1,2-connection:

Formula 4

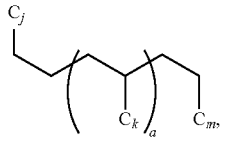

where j, k and m are each, independently, 3, 4, 5, 6, 7, 8, 9, 10, 11, 12, 13, 14, 15, 16, 17, 18, 19, 20, 21 or 22, n is an integer from 1 to 350 (preferably 1 to 300, preferably 5 to 50) as measured by proton NMR.

Any of the mpolyalphaolefins (mPAO) described herein may have an Mw (weight average molecular weight) of 100,000 or less, preferably between 100 and 80,000, preferably between 250 and 60,000, preferably between 280 and 50,000, preferably between 336 and 40,000 g/mol.

Any of the mpolyalphaolefins (mPAO) described herein may have a Mn (number average molecular weight) of 50,000 or less, preferably between 200 and 40,000, preferably between 250 and 30,000, preferably between 500 and 20,000 g/mol.

Any of the mpolyalphaolefins (mPAO) described herein may have a molecular weight distribution (MWD-Mw/Mn) of greater than 1 and less than 5, preferably less than 4, preferably less than 3, preferably less than 2.5. The MWD of mPAO is always a function of fluid viscosity. Alternately, any of the polyalphaolefins described herein may have an Mw/Mn of between 1 and 2.5, alternately between 1 and 3.5, depending on fluid viscosity.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 ml/min, and a sample concentration of 1 wt %, and the Column Set is a Phenogel 500 A, Linear, 10E6A.

Any of the m-polyalphaolefins (mPAO) described herein may have a substantially minor portion of a high end tail of the molecular weight distribution. Preferably, the mPAO has not more than 5.0 wt % of polymer having a molecular weight of greater than 45,000 Daltons. Additionally or alternatively, the amount of the mPAO that has a molecular weight greater than 45,000 Daltons is not more than 1.5 wt %, or not more than 0.10 wt %. Additionally or alternatively, the amount of the mPAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

Any mPAO described herein may have a pour point of less than 0° C. (as measured by ASTM D97), preferably less than −10° C., preferably less than 20° C., preferably less than −25° C., preferably less than −30° C., preferably less than −35° C., preferably less than −50° C., preferably between −10° C. and −80° C., preferably between −15° C. and −70° C.

mPolyalphaolefins (mPAO) made using metallocene catalysis may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 8 cSt to about 500 cSt as measured by ASTM D445.

Other PAOs useful in the present invention include those made by the process disclosed in U.S. Pat. Nos. 4,827,064 and 4,827,073. Those PAO materials, which are produced by the use of a reduced valence state chromium catalyst, are olefin oligomers of polymers which are characterized by very high viscosity indices which give them very desirable properties to be useful as lubricant base stocks and, with higher viscosity grades, as VI improvers. They are referred to as High Viscosity Index PAOs or HVI-PAOs.

Various modifications and variations of these high viscosity PAO materials are also described in the following U.S. patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. Nos. 5,012,020 and 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: $C_{30}$ to $C_{1300}$ hydrocarbons having a branch ratio of less than 0.19, a weight average molecular weight of between 300 and 45,000, a number average molecular weight of between 300 and 18,000, a molecular weight distribution of between 1 and 5. HVI-PAOs are fluids with 100° C. viscosity ranging from 3 to 5000 $mm^2/s$ or more. The fluids with viscosity at 100° C. of 3 $mm^2/s$ to 5000 $mm^2/s$ have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of $C_6$ to $C_{20}$ 1-alkenes. Examples of the feeds can be 1-hexene, 1-octene, 1-decene, 1-dodecene, 1-tetradecene, etc. or mixture of $C_6$ to $C_{14}$ 1-alkenes or mixture of $C_6$ to $C_{20}$ 1-alkenes, $C_6$ and $C_{12}$ 1-alkenes, $C_6$ and $C_{14}$ 1-alkenes, $C_6$ and $C_{16}$ 1-alkenes, $C_6$ and $C_{18}$ 1-alkenes, $C_8$ and $C_{10}$ 1-alkenes, $C_8$ and $C_{12}$ 1-alkenes, $C_8$, $C_{10}$ and $C_{12}$ 1-alkenes, and other appropriate combinations.

The products usually are distilled to remove any low molecular weight compositions such as those boiling below 600° F., or with carbon numbers less than $C_{20}$, if they are produced from the polymerization reaction or are carried over from the starting material. This distillation step usually improves the volatility of the finished fluids.

The fluids made directly from the polymerization or oligomerization process usually have unsaturated double bonds or have olefinic molecular structure. The amount of double bonds or unsaturation or olefinic components can be measured by several methods, such as bromine number (ASTM D1159), bromine index (ASTM D2710) or other suitable analytical methods, such as NMR, IR, etc. The amount of the double bond or the amount of olefinic compositions depends on several factors—the degree of polymerization, the amount of hydrogen present during the polymerization process and the amount of other promoters which anticipate in the termination steps of the polymerization process, or other agents present in the process. Usually the amount of double bonds or the amount of olefinic components is decreased by the higher degree of polymerization, the higher amount of hydrogen gas present in the polymerization process or the higher amount of promoters participating in the termination steps.

It is known that, usually, the oxidative stability and light or UV stability of fluids improves when the amount of unsaturation double bonds or olefinic contents is reduced. Therefore, it is desirable to hydrotreat the polymer if it has a high degree of unsaturation. Usually the fluids with bromine number of less than 5, as measured by ASTM D1159, is suitable for high quality base stock application. Of course, the lower the bromine number, the better the lube quality. Fluids with bromine numbers of less than 3 or 2 are common. The most preferred range is less than 1 or less than 0.1. The method to hydrotreat to reduce the degree of unsaturation is well known in literature (U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, it can be used as is without hydrotreating, or it can be hydrotreated to further improve the base stock properties.

Group V base stocks are classified by the American Petroleum Institute as those oils which do not fall within Groups I, II, III or IV. Such oils, therefore, include esters, polyol esters, silicone oils, alkylated aromatics, alkyl phosphates, etc.

Regardless of their origin or process or technique used for their production, the first low kinematic viscosity fluid can be employed as a single component oil or as a mixture of oils provided the single oil or mixture of oils has a low kinematic viscosity in the range of 2 to 12 $mm^2/s$ at 100° C.

Thus, the low kinematic viscosity fluid can constitute a single base stock/oil falling within the recited kinematic viscosity limits or it can be made up of two or more base stocks/oils, each individually falling within the recited kinematic viscosity limits. Further, the low kinematic viscosity fluid can be made up of mixtures of one, two or more low viscosity stocks/oils, e.g. stocks/oils with kinematic viscosities in the range of 2 to 12 $mm^2/s$ at 100° C. combined with one, two or more high kinematic viscosity stocks/oils, e.g. stocks/oils with kinematic viscosities greater than 12 $mm^2/s$ at 100° C., such as stocks with kinematic viscosities of 100 $mm^2/s$ or greater at 100° C., provided that the resulting mixture blend exhibits the target low kinematic viscosity of 2 to 12 $mm^2/s$ at 100° C. recited as the viscosity range of the first low kinematic viscosity stock.

The second oil used in the bimodal blend is a high kinematic viscosity Group IV fluid, i.e. a PAO with a kinematic viscosity at 100° C. of at least 38 $mm^2/s$, preferably a kinematic viscosity in the range of about 38 to 1200 $mm^2/s$, more preferably about 38 to 600 $mm^2/s$.

In regard to the second, high kinematic viscosity base stock, it can be made up of a single PAO base stock/oil meeting the recited kinematic viscosity limit or it may be made up of two or more PAO base stocks/oils, each of which meet the recited kinematic viscosity limit. Conversely, this second high kinematic viscosity PAO base stock/oil can be a mixture of one, two or more lower kinematic PAO base stocks/oils, e.g. stocks/oils with kinematic viscosities of less than 38 $mm^2/s$ at 100° C. combined with one, two or more high kinematic viscosity PAO base stocks/oils, provided that the resulting mixture blend meets the target high kinematic viscosity of at least 38 $mm^2/s$ at 100° C.

Such higher kinematic viscosity PAO fluids can be made using the same techniques previously recited.

Preferably the high kinematic viscosity PAO fluid which is the second fluid of the bimodal mixture is made employing metallocene catalysis or the process described in U.S. Pat. Nos. 4,827,064 or 4,827,073.

Regardless of the technique or process employed to make PAO, the PAO fluid used as the second base stock of the bimodal blend is a high kinematic viscosity PAO having a KV at 100° C. of at least 38 $mm^2/s$, preferably 38 to 1200 $mm^2/s$, more preferably 38 to 600 $mm^2/s$, the only proviso being that the PAO stock used be liquid at ambient temperature.

The present invention achieves its reduction in traction coefficient by use of a lubricant comprising a bimodal blend of two different base stock, the first being one or more Group I, Group II, Group III, Group IV or Group V base stocks, preferably one or more Group I, Group II, Group III or Group IV base stocks, more preferably one or more Group I, Group II or Group III base stocks, most preferably one or more Group III base stocks having a KV at 100° C. of from 2 to 12 $mm^2/s$ and the second being one or more Group IV base stocks having a KV at 100° C. of at least 38, preferably 38 to 1200 $mm^2/s$, more preferably 38 to 600 $mm^2/s$, provided there is a difference in KV between the first and second base stock of at least 30 $mm^2/s$ and the blend has a KV at 100° C. of 25 $mm^2/s$ or less. When using such bimodal blends of base stocks, the traction coefficient of the oil being used at a surface speed of at least about 3 mm/s, preferably at least about 30 mm/s, more preferably at least about 50 mm/s, is reduced as compared to using engine oils which are not bimodal to the same degree as recited or which are based entirely on Group I and/or Group II base stocks.

The method for reducing traction coefficient uses engine lubricating oil composition as described above containing the bimodal base stock blend as a minimum necessary and essential component.

The method can use engine lubricating oils containing additional performance additives provided the base stock comprises the essential bimodal blend base stock.

Formulated lubricating oil using the bimodal blend of base stocks as recited in the present specification may additionally contain one or more of the commonly used lubricating oil performance additives including but not limited to dispersants, detergents, corrosion inhibitors, rust inhibitors, metal deactivators, other anti-wear and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

COMPARATIVE EXAMPLES AND EXAMPLES

A series of engine oils was evaluated in regard to the effect base stock composition has on traction coefficient. The engine oils were unadditized base stock blends. The traction coefficient was measured employing the MTM Traction Rig, which is a fully automated Mini Traction Machine traction measurement instrument. The rig is manufactured by PCS Instruments and identified as Model MTM. The test specimens and apparatus configuration are such that realistic pressures, temperatures and speeds can be attained without requiring very large loads, motors or structures. A small sample of fluid (50 ml) is placed in the test cell and the machine automatically runs through a range of speeds, slide-to-roll ratios, temperatures and loads to produce a comprehensive traction map for the test fluid without operational intervention. The standard test specimens are a polished 19.05 mm ball and a 50.0 mm diameter disc manufactured from AISI 52100 bearing steel. The specimens are designed to be single use, throw away items. The ball is loaded against the face of the disc and the ball and disc are driven independently by DC servo motors and drives to allow high precision speed control, particularly at low slide/roll ratios. Each specimen is end mounted on shafts in a small stainless steel test fluid bath. The vertical shaft and drive system which supports the disk test specimen is fixed. However, the shaft and drive system which supports the ball test specimen is supported by a gimbal arrangement such that it can rotate around two orthogonal axes. One axis is normal to the load application direction, the other to the traction force direction. The ball and disk are driven in the same direction. Application of the load and restraint of the traction force is made through high stiffness force transducers appropriately mounted in the gimbal arrangement to minimize the overall support system deflections. The output from these force transducers is monitored directly by a personal computer. The traction coefficient is the ratio of the traction force to the applied load. As shown in FIGS. 1-4, the traction coefficient was measured over a range of speeds. In FIGS. 1-4, the speed on the x-axis is the entrainment speed, which is half the sum of the ball and disk speeds. These entrainment speeds simulate the range of surface speeds, or at least a portion of the range of surface speeds, reached when the engine is operating.

The test results presented herein were generated under the following test conditions:

| | |
|---|---|
| Temperature | 100° C. |
| Load | 1.0 GPa |
| Slide-to-roll ratio (SRR) | 50% |
| Speed gradient | 0-3000 mm/sec in 480 seconds |

The oils are described in Table 1.

TABLE 1

| Oil Designation | Base Stock (KV at 100° C.) | Base Stock Mixture (KV at 100° C.) | Nominal ΔKV at 100° C. ($mm^2/s$) |
|---|---|---|---|
| Reference Oil A | Group I (7.5 $mm^2/s$)<br>Group I (32 $mm^2/s$) | 13 | 24.5 |
| Reference Oil B | Group I (4.2 $mm^2/s$)<br>PIB (2500 MW) | 16 | 4000 |
| Reference Oil C | Group II (10 $mm^2/s$)<br>Group I (12 $mm^2/s$) | 11 | 2 |
| Reference Oil D | Group II (12 $mm^2/s$)<br>Group I (32 $mm^2/s$) | 13 | 20 |
| I | Group I (4.2 $mm^2/s$)<br>Group IV (150 $mm^2/s$) | 16 | 146 |
| II | Group II (3 $mm^2/s$)<br>Group IV (150 $mm^2/s$) | 13 | 147 |
| III | Group III (6.5 $mm^2/s$)<br>Group IV (150 $mm^2/s$) | 16 | 147 |
| IV | Group III (6.5 $mm^2/s$)<br>Group IV (150 $mm^2/s$) | 13 | 143.5 |
| V | Group III (6.5 $mm^2/s$)<br>Group IV (300 $mm^2/s$) | 16 | 293.5 |
| VI | Group IV (6 $mm^2/s$)<br>Group IV (40 $mm^2/s$) | 9 | 33.5 |
| VII | Group IV (8 $mm^2/s$)<br>Group IV (40 $mm^2/s$) | 13 | 32.0 |

The Group III stock used in the above is a slack wax isomerate made by subjecting slack wax to hydrotreating to remove sulfur and nitrogen compounds, which desulfurized and denitrogenated slack wax was then hydroisomerized followed by hydrofinishing. The Group IV stocks used in the above are PAOs.

As seen from FIG. 1, the blend of Group I stock with a Group IV stock (Oil I) exhibited a reduction in traction coefficient at speeds of about 30 mm/s and higher compared to Reference oils A and B.

Figure 2:
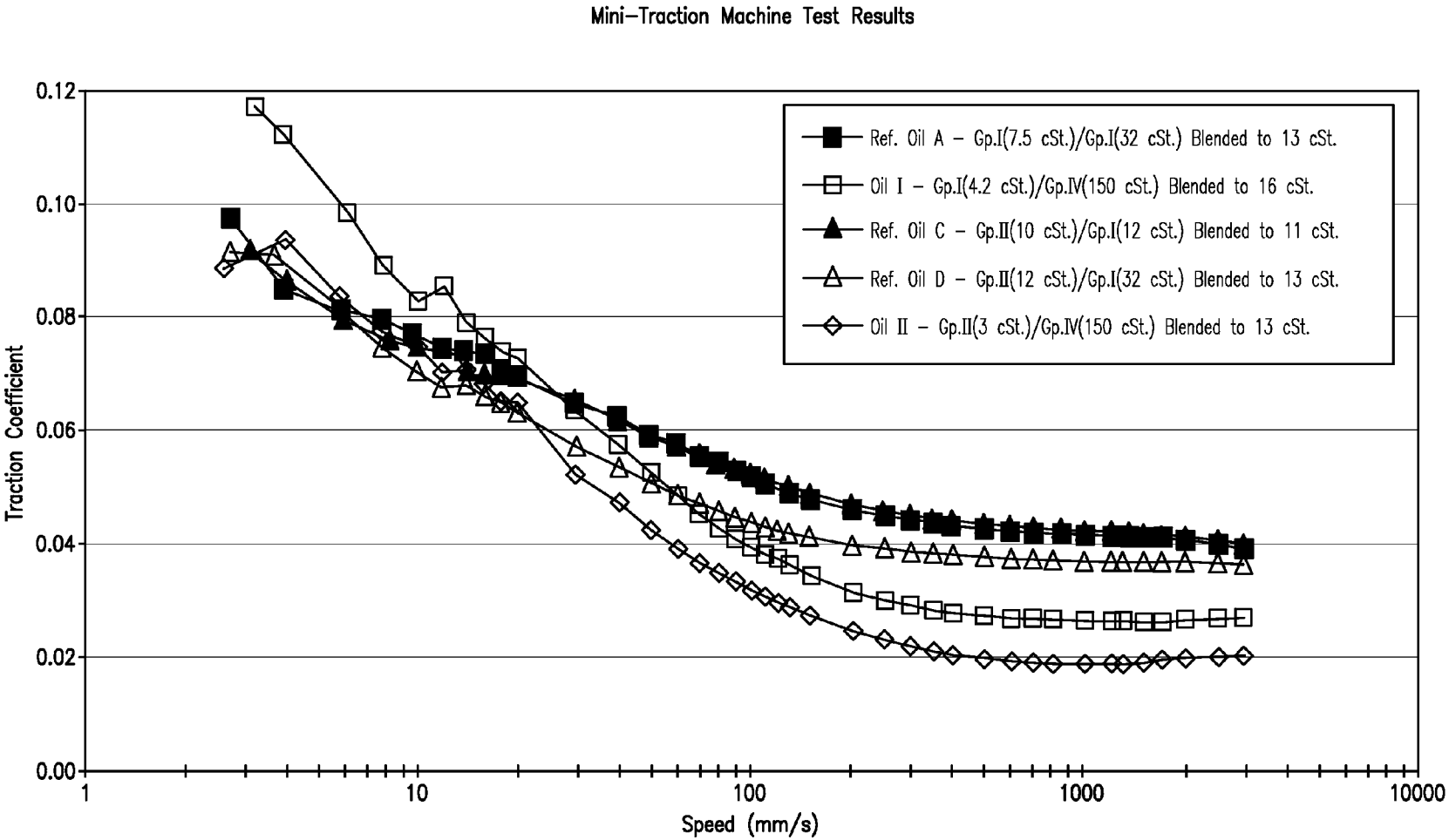
FIG. 2 presents the effect on traction coefficient exhibited by a blend of a low KV Group I oil with a high KV Group IV oil and a blend of a low KV Group II oil with a high KV Group IV oil compared to reference oils constituting a blend of a low KV Group I oil and a high KV Group I oil, or of two different blends of low KV Group II oils with either a low KV Group I or a high KV Group I oil.

FIG. 2 shows that the blend of Group II stock with a Group IV stock (Oil II) exhibited a reduction in traction coefficient at speeds of about 30 $mm^2/s$ and higher as compared to Reference oils A, C and D while the blend of Group I stock with a Group IV stock (Oil I) exhibited a reduction in traction coefficient at speeds of about 100 mm/s and higher as compared to Reference oil D.

Figure 3:
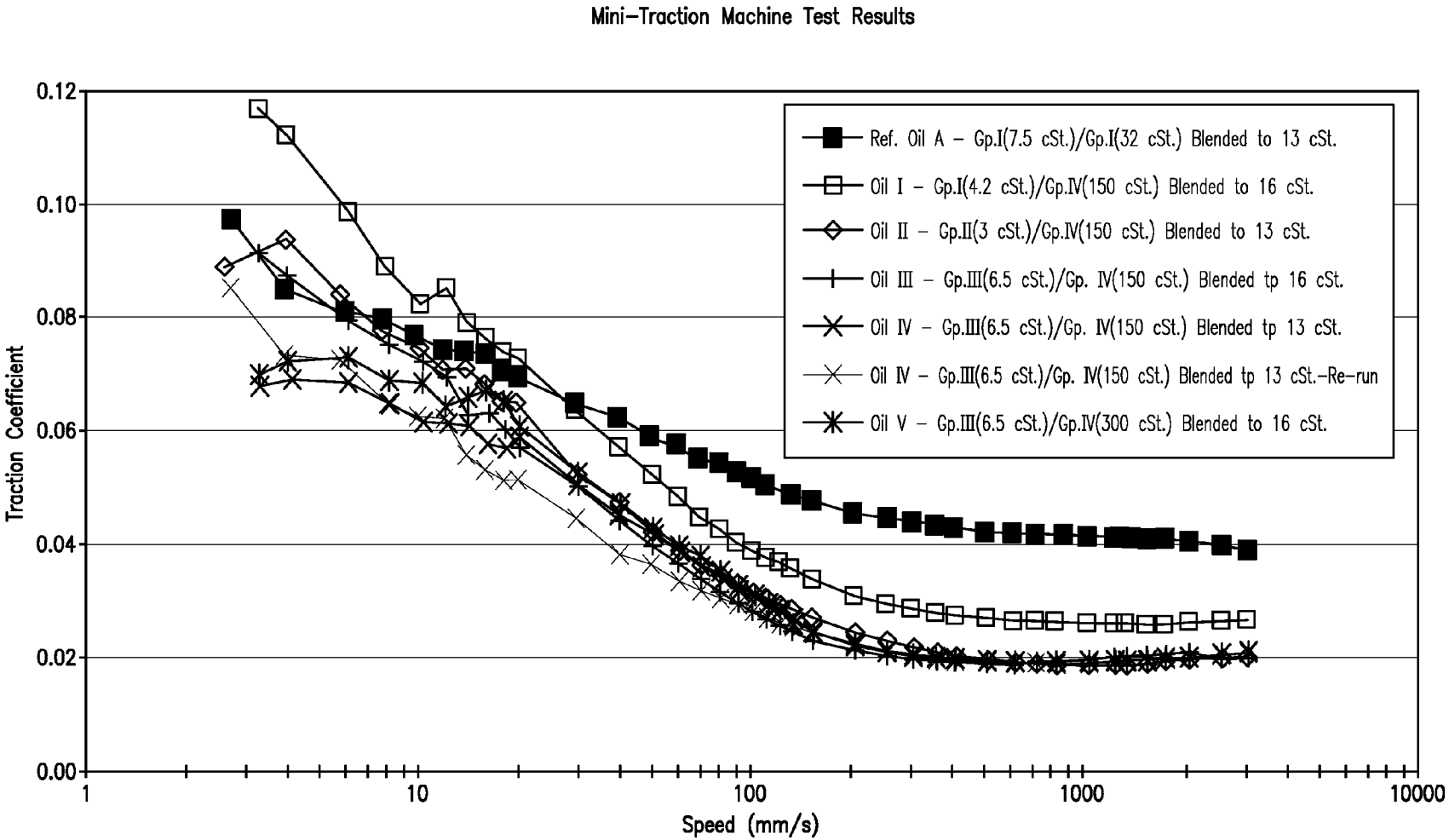
FIG. 3 presents the effect on traction coefficient exhibited by blends of low KV Group I, Group II, Group III or Group IV oils with high KV Group IV oils compared to a reference oil constituting a blend of a low KV Group I oil and a high KV Group I oil.

FIG. 3 shows that the blend of Group III stock with a Group IV stock (Oil III, Oil IV and Oil V) exhibited a reduction in traction coefficient at all speeds tested (as low as 3 mm/s) compared to Reference oil A and all other Oils evaluated.

Figure 4:
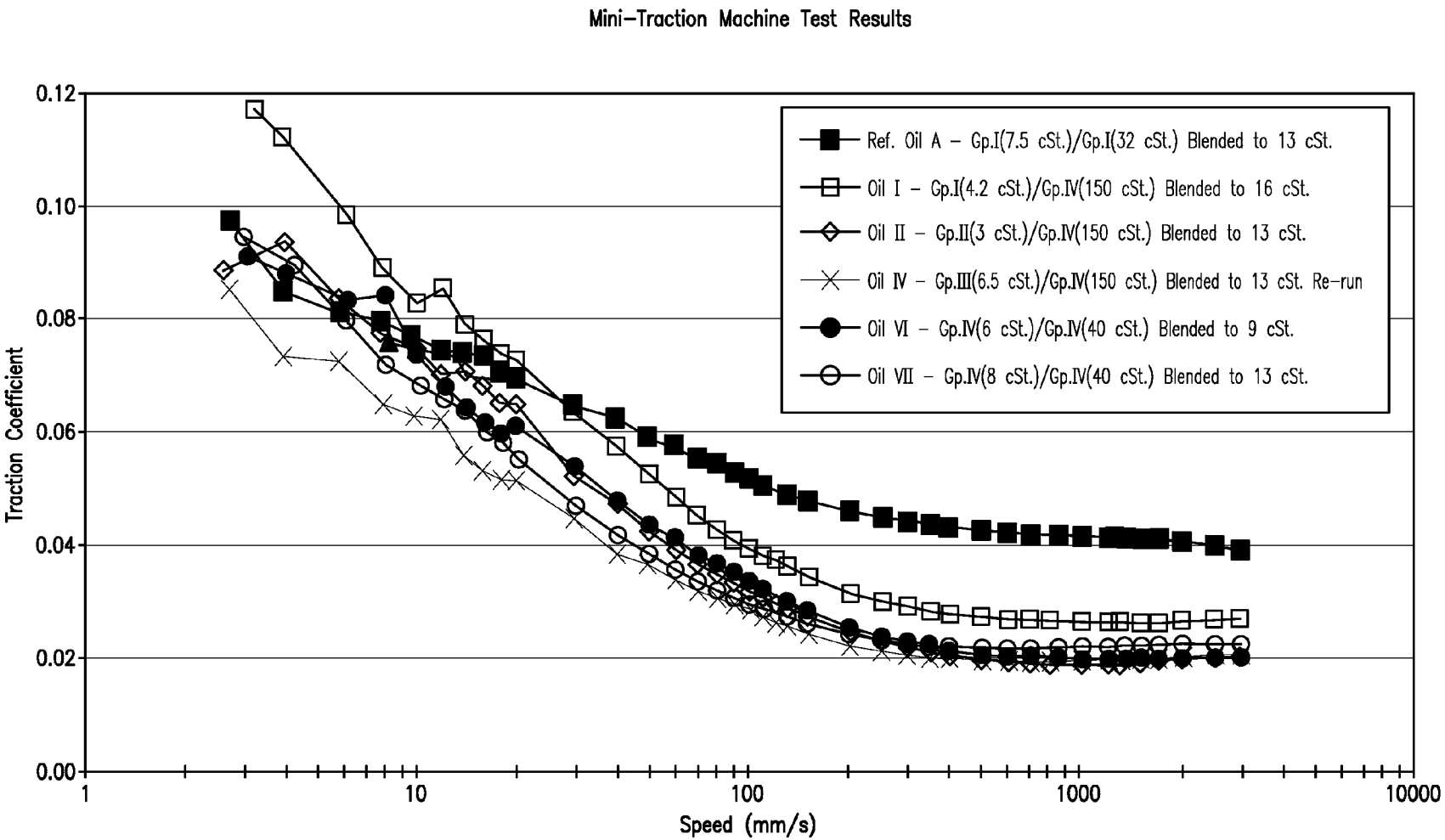
FIG. 4 presents the effect on traction coefficient exhibited by blends of low KV Group I, Group II, Group III or Group IV oils with high KV Group IV oils blended to different blend kinematic viscosities compared to a reference oil constituting a blend of a low KV Group I oil and a high KV Group I oil.

FIG. 4 shows that blends of Group IV stocks of different kinematic viscosities producing bimodal blends having a AKV of at least 32 $mm^2/s$ (Oils VI and VII) exhibited a reduction in traction coefficient at all speeds tested (as low as 3 mm/s).

What is claimed is:

1. A method for improving the fuel economy of large low and medium speed engines that reach surface speeds of at least about 100 mm/s and are lubricated by an engine oil by reducing the traction coefficient of the engine oil used to lubricate the engine by employing as the engine oil a lubricating oil comprised of a base oil comprising a bimodal blend of two different base oils, the first base oil being one or more oils selected from the group consisting of Group I, Group II and Group III base oils, said first base oil having a kinematic viscosity at 100° C. of from 2 to 4.2 $mm^2/s$ and a second base oil selected from one or more oils selected from Group IV base oils having a kinematic viscosity at 100° C. of 150 to 1200 $mm^2/s$, the difference in kinematic viscosity between the first and second base oils being at least 140 $mm^2/s$, the combination of the first and second base oils having a kinematic viscosity at 100° C. of 13 to 25 $mm^2/s$ or less wherein the improvement in fuel economy is evidenced by the traction coefficient of the engine oil employing the bimodal blend being lower than the traction coefficient of engine oils which are not bimodal or which are not bimodal to the same degree as recited or which are based on mixtures of two or more Group I base oils or mixtures of two or more Group II base oils or mixtures of Group I and Group II base oils.

2. The method of claim 1 wherein the second base oil is a PAC base oil.

3. The method of claim 2 wherein the second base oil is made employing metallocene catalysis.

4. The method of claim 2 wherein the second base oil is PAO base oil characterized by not more than 5.0 wt % of the polymer having a molecular weight of greater than 45,000 Daltons.

* * * * *